US005385524A

United States Patent [19]

Jahoda

[11] Patent Number: 5,385,524

[45] Date of Patent: Jan. 31, 1995

[54] EXERCISE DEVICE

[76] Inventor: Frantisek Jahoda, Am Schreiberg 7, A-5201 Seekirchen, Austria

[21] Appl. No.: 61,173

[22] Filed: May 12, 1993

[30] Foreign Application Priority Data

May 13, 1992 [DE] Germany ..... 4215754

[51] Int. Cl.[6] ..... A63B 21/00

[52] U.S. Cl. ..... 482/113; 482/112

[58] Field of Search ..... 482/111-113, 482/133, 128, 142, 53; 128/25 R, 774, 781, 782, 4-8; 188/129; 267/196; 92/117 A, 117 R; 417/118, 120, 130, 131

[56] References Cited

U.S. PATENT DOCUMENTS

| | | | |
|---|---|---|---|
| 3,128,094 | 1/1962 | Wolf | 482/113 |
| 4,550,908 | 11/1985 | Dixon | 482/111 |
| 4,832,335 | 5/1989 | Tong | 482/112 |
| 4,880,230 | 11/1989 | Cook | 482/113 |
| 5,152,732 | 10/1992 | Sayre | 482/112 |
| 5,178,160 | 1/1993 | Gracovetsky et al. | 482/112 |
| 5,236,407 | 8/1993 | Wang | 482/113 |
| 5,277,682 | 1/1994 | Chen | 482/113 |

FOREIGN PATENT DOCUMENTS

| | | | |
|---|---|---|---|
| 0135346 | 3/1985 | European Pat. Off. | 482/112 |

*Primary Examiner*—Richard J. Apley
*Assistant Examiner*—Jerome Donnelly
*Attorney, Agent, or Firm*—Collard & Roe

[57] ABSTRACT

An apparatus for exercising an individual's muscles, including a hollow housing having a central hollow cylindrical section and a flange at one end of said cylindrical section. The flange end of the housing is mounted to a wall and an elbow joint permits the housing to be pivoted with respect to said wall. The side of the housing opposite the flange is provided with a support surface. An airtight disc or piston is movably positioned within said cylindrical section and is movable along a longitudinal axis of said cylindrical section. A rod extends from the center of a piston through said support surface and terminates in a handle. A cover plate which faces said support surface is removably attached to said rod; and a series of replaceable suction cup are fastened onto said cover plate which faces said support surface. In use an individual pulls on said handle and must first overcome the holding force of said suction cup before the movement of said handle is resisted by a nearly constant force of a vacuum forming within said cylindrical section between said flange and said piston.

4 Claims, 2 Drawing Sheets

FIG. 2
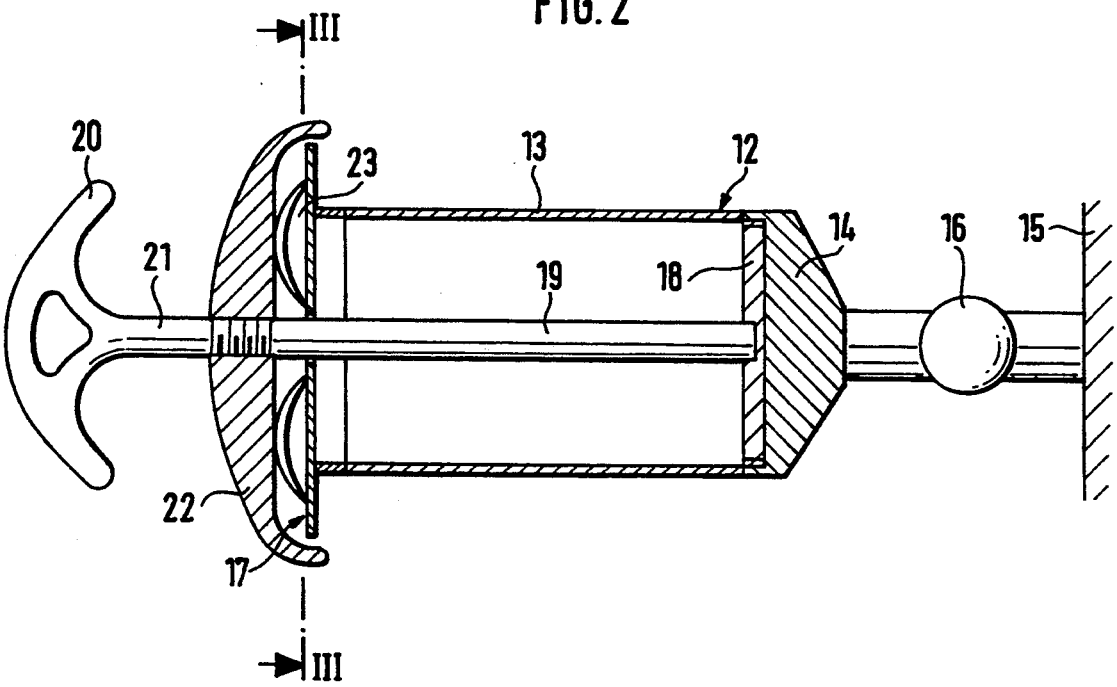
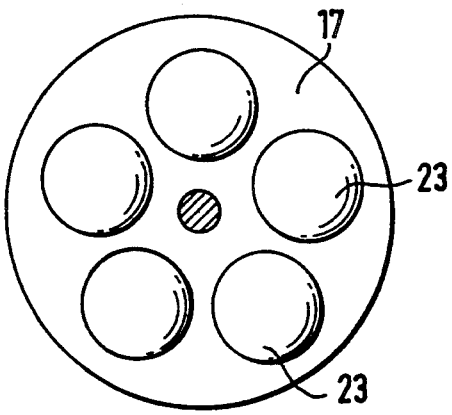
FIG. 3

EXERCISE DEVICE

BACKGROUND OF THE INVENTION

1. Field of the Invention

The present invention relates to an exercise device that provides resistance when pulled. More particularly, the invention relates to an exercise device that provides two or more levels of resistive force.

2. The Prior Art

Exercise devices are known from the prior art, for example, spring-biased expanders. With the known expanders, muscles can be trained by expending power to oppose and overcome the biasing force of the spring. Initially, the spring provides a low resistance, but the resistance increases, in accordance with the spring characteristics, as the spring is further pulled apart or compressed. The resistive force of the spring, which increases more or less linearly, only stresses the red muscle fibers. The white muscle fibers, which are responsible for explosive force, are not stressed by the known devices.

Therefore, it would be advantageous to have an exercise device which provides at least two stages of resistive force, for stressing both the white muscle fibers and the red muscle fibers.

SUMMARY OF THE INVENTION

It is therefore an object of the present invention to provide an exercise device which stresses both the red and white muscle fibers.

It is another object of the present invention to provide an exercise device that includes at least two separate resistance levels.

These and other related objects are achieved according to the invention by an apparatus for exercising an individual's muscles having a hollow housing with a first support surface. A first suction cup is movably disposed within the housing. A first handle is attached to the first suction cup and extends outwardly of the housing. Attachment means are located within the housing for attaching to the first suction cup. Biasing means, varying resistance means or spring means are disposed between the first support surface and the first suction cup for biasing the first suction cup in a direction toward the attachment means. The individual exerts force on the first handle to detach the first suction cup from the attachment means, and then move the first suction cup against the biasing force of the spring means.

The first handle is elastically attached to the first suction cup. The attachment means comprises a second suction cup. The apparatus further includes a second handle attached to the second suction cup and extending outwardly of the housing. The housing includes a second support surface and the biasing means is further disposed between the second support surface and the second suction cup for biasing the second suction cup toward said first suction cup. The second handle is elastically attached to the second suction cup.

The housing is made up of two or more elastic sections and includes at least one extension member. The biasing means includes a pair of collars movable against the support surfaces to define a stop position. The biasing means consists of elastic straps arranged serially or in parallel. The suction cups move along an axis that extends through the handles. The springs are parallel or concentric with the axis. The biasing means is formed from a pneumatic buffer or a vacuum-assisted buffer. Each suction cup includes a valve for controlling the force of suction.

The apparatus according to the invention can be designed so that at the start of the exercise stroke, a high resistance must be first overcome by a dynamic movement. This dynamic movement primarily requires exertion by the white muscle fibers which are responsible for rapid motions. Following the dynamic movement, the apparatus functions as a classical expander. In this phase, the exercise device has a continuously increasing resistance developed by one or more springs. The springs may be connected serially or in parallel. The springs stress the slower acting red muscle fibers.

In an alternate embodiment of the invention, the exercise device has a low initial resistance with increasing resistance. At the end of the exercise stroke, a dynamic explosive force is required. The dynamic explosive force may be developed through some type of damping. Following the dynamic explosive force, a continuously increasing resistive force for extending or compressing additional springs is provided.

The device according to the invention permits special training of both the red and white muscle fibers which increases the performance of both muscle groups. The white fiber bundles are innervated and rearranged in parallel to each other in which they provide superior performance.

BRIEF DESCRIPTION OF THE DRAWINGS

Other objects and features of the present invention will become apparent from the following detailed description considered in connection with the accompanying drawings which disclose two embodiments of the present invention. It should be understood, however, that the drawings are designed for the purpose of illustration only and not as a definition of the limits of the invention.

In the drawings, wherein similar reference characters denote similar elements throughout the several views:

FIG. 2 is a side-elevational view, in part cross section, of an alternate embodiment of the exercise device mounted on a wall and having a single handle.

FIG. 3 is a cross-sectional view taken along the line 3—3 from FIG. 2.

DETAILED DESCRIPTION OF PREFERRED EMBODIMENTS

Figure 1:
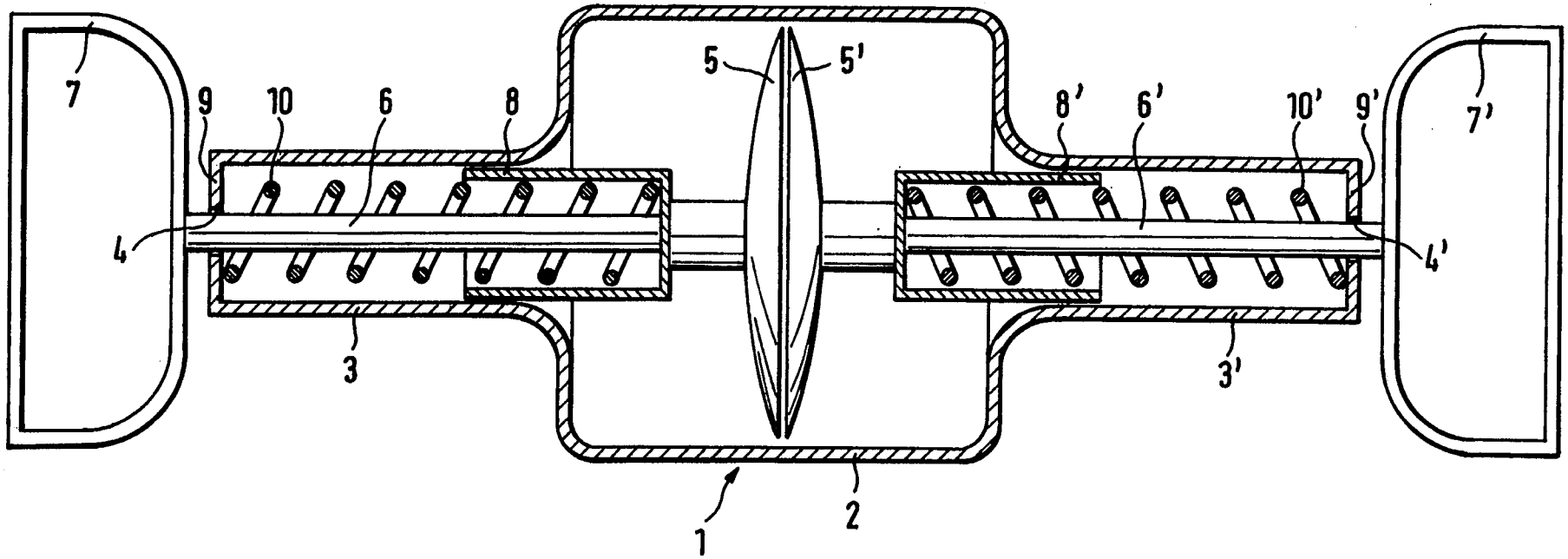
FIG. 1 is a side-elevational view, in part cross section, of an embodiment of the exercise device with two handles.

Referring now in detail to the drawings and, in particular, FIG. 1, there is shown an embodiment of the invention having a housing 1 which includes a central hollow cylindrical section 2. A pair of hollow cylindrical projections 3 and 3' extend from either side of central hollow cylindrical section 2. Extensions 3 and 3' are coaxial with cylindrical section 2 and have a smaller diameter than cylindrical section 2. Housing 1 may be assembled from two or more parts, for example, cylindrical section 2 may consist of two hollow cylinders that can be locked together, for example, by a threaded connection, with a bayonet catch, or any other known connection means.

Alternatively, housing 1 is divisible along a plane that intersects the central axis of cylindrical section 2 and cylindrical extensions 3. The housing halves are freely movable with respect to each other, or may be pivotally connected to each other by means of one or more hinges. If housing 1 is divisible into several parts, a locking device such as a snap lock, or locking bars, for example, may be provided. Housing 1 may be made from a variety of materials, for example, a rigid material, a partially elastic material, or a totally elastic material. If a hard material is used, a soft material may surround housing 1 to help minimize possible injuries to the users. In addition, the locks or locking bars may be covered by a cushioned covering hood. Alteratively, housing 1 may have a tubular body with a constant diameter, i.e., cylindrical section 2 and cylindrical extensions 3 and 3', have the same diameter.

The free ends of cylindrical extensions 3 and 3' have bores 4 and 4', respectively, which are concentric with cylindrical extensions 3 and 3', for example. A pair of suction cups 5 and 5' are disposed within cylindrical section 2 with their open ends facing each other. Flexible cables 6 and 6', for example, rubber cables, are attached to suction cups 5 and 5', respectively. Flexible cables 6 and 6' extend outwardly of housing 1 through bores 4 and 4', respectively. A pair of handles 7 and 7' are attached to the external ends of flexible cables 6 and 6', respectively.

Flexible cables 6 and 6' may be removably attached to suction cups 5 and 5' and/or handles 7 and 7'. The connections may include a screw connection, a bayonet connection, or any other type of removable coupling. Alternatively, flexible cables 6 and 6' may be permanently attached to suction cups 5 and 5' or handles 7 and 7'. A pair of sleeves 8 and 8' are located on flexible cables 6 and 6', respectively. Sleeves 8 and 8' are disposed at one end of cylindrical extensions 3 and 3' where they join with cylindrical section 2. Sleeves 8 and 8' have an open end that faces handles 7 and 7' respectively The outer dimensions of sleeves 8 and 8' are slightly smaller than the inner dimensions of cylindrical extensions 3 and 3' so that sleeves 8 and 8' can easily slide along the length of cylindrical extensions 3 and 3'.

A pair of cover plates 9 and 9' are located at the outwardly projecting ends of cylindrical extensions 3 and 3', respectively. Bores 4 and 4' are located within cover plates 9 and 9', respectively. A coil spring 10 and 10' surround flexible cables 6 and 6', respectively. Coil springs 10 and 10' are disposed between sleeves 8 and 8' and covers 9 and 9'. Sections of the exercise device are removable in order to replace coil springs 10 and 10' with other springs having different force characteristics.

The exercise device operates as follows. In the starting position, suction cups 5 and 5' are coupled together within cylindrical section 2. The individual grips handle 7 with one hand and handle 7' with the other hand and tries to pull handles 7 and 7' apart. Flexible cable 6 and 6' are stretched until the restoring force of the cables reaches the force necessary to separate suction cups 5 and 5'. Once suction cups 5 and 5' are separated, flexible cables 6 and 6' contract to absorb the sudden release of force brought about by the separation of suction cups 5 and 5'. The force is further absorbed by springs 10 and 10'. A further application of force on handles 7 and 7' compresses springs 10 and 10'. Springs 10 and 10' are compressed until sleeves 8 and 8' contact cover plates 9 and 9'. A further application of force on handles 7 and 7' stretches flexible cables 6 and 6'.

Alternatively, cables 6 and 6' may be non-flexible. Under these conditions, the exercise device operates as follows. Initially, an explosive force must be exerted in order to separate suction cups 5 and 5'. Following the separation of suction cups 5 and 5', springs 10 and 10' are compressed until sleeves 8 and 8' contact cover plates 9 and 9', respectively. If housing 1 is made from a flexible material, further exertion of force on handles 7 and 7', will stretch housing 1. Housing 1 may also serve as a damping device.

Parts of the exercise device can be removable or interchangeable so that the resistance characteristics of the individual components may be varied. Different suction cups, different coil springs, different cables and different housing parts may be interchanged so that the device may provide different resistance characteristics. In a further embodiment of the invention, additional suction cups are provided along the length of cables 6 and 6' that open at a higher force than suction cups 5 and 5'. The additional suction cups would then be separated after sleeves 8 and 8' have contacted cover plates 9 and 9'. Alternatively, an additional stop may be provided for suction cups 5 and 5' within cylindrical extensions 3 and 3'. Once suction cups 5 and 5' have reached the additional stop, further force on handles 7 and 7' will separate the additional suction cups. Instead of having two suction cups 5 and 5', one of the suction cups may be a flat support surface. The suction cups and support surfaces are interchangeable.

Further embodiments of the exercise device include only a single handle and only half of the assembly shown in FIG. 1. The single handle device can be attached to a rigid wall with the suction cup attaching to a counter piece that is attached to the wall. In place of spring 10, the handle may be coupled to an air tight piston which is biased toward the wall by a vacuum source mounted within the wall. In this manner, an adjustment of the vacuum level, for example, with a valve, could adjust the resistive force on the handle. Such a device having a single handle, will allow training of one arm or one leg at a time. Two devices each with a single handle could be mounted next to each other on the wall for training both legs and/or both arms.

Springs 10 and 10' may be replaced by any elastic material that can be expanded or compressed through the application of force and which returns again to its initial positions once the force is removed. Coil springs, spiral springs, rubber or elastic plastics can be used, for example.

Referring now to FIG. 2, there is shown a housing 12 having a central hollow cylindrical section 13 and a flange 14 at one end of cylindrical section 13. The flange end of housing 12 is mounted on a wall 15. An elbow joint 16 permits housing 12 to be pivoted with respect to wall 15. The side of housing 12 opposite flange 14 is provided with a support surface 17. An airtight disc or piston 18 is movably positioned within cylindrical section 13 and is movable along a longitudinal axis 21 of cylindrical section 13. A rod 19 extends from the center of piston 18 through support surface 17 and terminates in a handle 20. A cover plate 22, which faces support surface 17, is removably attached to rod 19. A series of replaceable suction cups are fastened onto cover plate 22 facing support surface 17. As can be seen in FIG. 3, five suction cups 23, for example, are arranged uniformly on cover plate 22 around central axis 21.

The exercise device in FIG. 2 is shown in its starting position. The individual pulls on handle 21 and must first overcome the holding force of suction cups 23. In order to detach suction cups 23 from support plate 17, a dynamic explosive force must be applied to handle 20. Basically, a relatively high force must be exerted over a short distance. Once suction cups 23 are detached from support surface 17, the movement of handle 20 is resisted by a nearly constant isokinetic force of the vacuum forming within cylindrical section 13 between flange 14 and piston 18. In this embodiment, the vacuum is equivalent to springs 10 and 10' which bias handles 7 and 7' back to their initial retracted positions. The vacuum force is adjusted to a sufficient level so that suction devices 23 are reattached to support surface 17 once the external force on handle 20 is released.

The exercise device according to the invention has universal application. It is possible to obtain vastly different resistive forces by varying the number or diameter of the suction cups, for example. The suction cups may additionally be provided with valves for controlling the suction force.

The force of the suction cups may be in the order of 300N to 2000N for each suction cup arrangement. The vacuum unit may also be variable to adjust the vacuum force. For example, housing 12 may be interchangeable with other housings of different diameters that will effect the vacuum force, which is dependent upon surface area. Instead of a vacuum unit, the restoring force may be provided by a pneumatic buffer or pneumatic piston.

While different embodiments of the present invention have been shown and described, it is to be understood that many changes and modifications may be made thereunto without departing from the spirit and scope of the invention as defined in the appended claims.

What is claimed is:

1. An apparatus for exercising an individual's muscles, comprising:

a hollow housing;

a rod member with a longitudinally-extending axis and two spaced ends, one of said ends is disposed within said housing and the other of said ends extends outwardly of said housing;

a handle attached to the outwardly extending end of said rod member for moving said rod member in a first axial direction; and varying resistance means for resisting movement of said rod member in said first axial direction, said varying resistance means comprising at least two resistance elements having different resistive force characteristics, at least one of said resistance elements is located within said hollow housing, wherein the individual exerts force on said handle to serially overcome the resistive force of said resistance elements.

2. Apparatus as claimed in claim 1, wherein said resistance elements are selected from a group consisting of a flexible rod member, a suction cup, and a spring.

3. Apparatus as claimed in claim 1, wherein said resistance elements are selected from a group consisting of a suction cup and a vacuum driven piston.

4. Apparatus as claimed in claim 1, wherein said resistance elements are selected from a group consisting of a suction cup, a spring, and a flexible housing.

* * * * *